US005722818A

United States Patent [19]

Ohta et al.

[11] Patent Number: 5,722,818

[45] Date of Patent: Mar. 3, 1998

[54] SUCTION VALVE ARRANGEMENT FOR A HERMETIC COMPRESSOR

[75] Inventors: Michio Ohta; Hirokazu Kawakami, both of Ohta; Shuji Kawashima, Gunma-ken, all of Japan

[73] Assignee: Sanyo Electric Co., Ltd., Osaka-fu, Japan

[21] Appl. No.: 707,178

[22] Filed: Sep. 3, 1996

[30] Foreign Application Priority Data

Sep. 5, 1995 [JP] Japan ..... 7-228064

[51] Int. Cl.[6] ..... F04B 37/00

[52] U.S. Cl. ..... 417/312; 417/571

[58] Field of Search ..... 417/312, 569, 417/571, 902; 137/855, 856, 857, 858

[56] References Cited

U.S. PATENT DOCUMENTS

| | | | |
|---|---|---|---|
| 2,859,912 | 11/1958 | Swart et al. | 417/571 |
| 2,908,287 | 10/1959 | Augustin | 417/571 |
| 3,200,838 | 8/1965 | Shaffer | 137/856 |

FOREIGN PATENT DOCUMENTS

| | | | |
|---|---|---|---|
| 85272 | 4/1988 | Japan | 417/571 |

*Primary Examiner*—Richard E. Gluck

*Attorney, Agent, or Firm*—Weingarten, Schurgin, Gagnebin & Hayes LLP

[57] ABSTRACT

A hermetically sealed type compressor having a valve seat plate equipped with a plurality of suction holes to effectively suck a refrigerant into a cylinder and capable of preventing the breakage of the valve seat plate coming from the opening and closing operations of a suction reed valve. A partition 50 between adjacent suction holes in the valve seat plate 15 is made to have a constant dimension, thus maintaining a given strength of the partition section and preventing the breakage of the partition 50 coming from the opening and closing movements of the suction reed valve. In addition, in the valve seat plate 15, a cavity 22 or a groove 37 is formed to define a low-pressure space 36 communicating with the plurality of suction holes 24, 25, thereby reducing the suction resistance.

10 Claims, 6 Drawing Sheets

SUCTION VALVE ARRANGEMENT FOR A HERMETIC COMPRESSOR

BACKGROUND OF THE INVENTION

1. Field of the Invention

The present invention relates to a hermetically sealed type compressor for use in refrigerators or the like, and more particularly to a reciprocation type compressor including a valve seat plate with a plurality of formed suction holes provided to close an end portion of a cylinder.

2. Background Art

Reciprocation type compressors are arranged such that a piston, being driven by an electric motor, reciprocates within a cylinder to suck, compress and discharge refrigerant which consequently circulates in a refrigerating cycle. The suction and discharge of the refrigerant into and from the cylinder are accomplished through a suction hole and a discharge hole made in a valve seat plate attached to a cylinder end portion. The suction and discharge holes come into open and closed states by means of a suction reed valve and a discharge reed valve attached to the valve seat plate in response to pressure variation due to the reciprocating movements of the piston within the cylinder. The suction resistance becomes smaller with a larger dimension of the suction hole made in the valve seat plate, with the result that the refrigerant can be sucked into the cylinder with a high efficiency. Particularly, in a case where a substitutive refrigerant, such as R134a, for the Freon is employed taking the recent Freon regulation problem into consideration, since its evaporation temperature (around −26° C.) is higher than the conventional Freon refrigerant R12 (−30° C. to −40° C.) to cause the refrigerating ability to lower, a refrigerating machine which can cope with the lowering of the refrigerating ability by increasing the flow rate of the refrigerant circulating in the refrigerating cycle is needed.

However, the size-increase of the suction hole accordingly increases the size of the suction reed valve opening and closing its opening so that difficulty is encountered to dispose it in a limited space. In addition, the stress to be applied to the suction reed valve increases during the opening and closing operations and hence the suction reed valve can be broken. For eliminating such a problem, as exemplified by the Japanese Published Examined Utility Model Application No. 53-32332, there has been known a hermetically sealed type compressor in which a plurality of suction holes are made in the longitudinal directions of a suction reed valve. The formation of the plurality of suction holes in a valve seat plate can reduce the suction resistance as a whole while restricting the size of each suction hole to eliminate a possibility of the breakage.

However, when the plurality of suction holes are made in the valve seat plate, with a given dimension, the suction holes have to be disposed close to each other. If the plurality of circular suction holes are formed to approach each other, the partition sections between the suction holes, present along straight lines passing through the centers of the respective circles, comes to a minimum dimension so that they can be broken due to the opening and closing movements of the suction reed valve. Particularly, in a case where the valve seat plate is made of a sintered metal, the sufficient strength of the partition sections is necessary. In addition, in the case of a small-size hermetically sealed type compressor, for the disposition of a plurality of suction holes in the dimension-limited valve seat plate to contribute a desired gas suction amount, difficulty is experienced to widen the separation (width of the partition sections) between the suction holes.

Moreover, in the hermetically sealed type compressor provided with a valve seat plate with a plurality of formed suction holes, the suction resistance needs to decrease in the manner of increasing the inside dimension of a passageway leading the refrigerant gas from a suction muffler toward the suction holes. However, increasing the inside dimension of the passageway places a limit to its disposition. For instance, in the case of using a valve seat plate with two suction holes, as illustrated in FIG. 10 being a cross-sectional view of a principal section around a cylinder end portion, the inside dimension of a passage pipe 18 to be inserted into a through-hole 35 made in a cylinder head 16 is smaller than that of the area the two suction holes 24, 25 made in a valve seat plate 15 stand, and the passage pipe 18 is required to be disposed so that the center of its opening is positioned at the neighboring portion (a partition 50) of the two suction holes 24, 25 to allow the opening to spread over the plurality of suction holes 24, 25. This construction results in a large suction resistance.

SUMMARY OF THE INVENTION

It is therefore an object of the present invention to provide a hermetically sealed type compressor which is capable of eliminating the aforesaid problems.

In accordance with the present invention, in a hermetically sealed type compressor comprising an electric motor unit placed within a hermetically sealing casing, a compressor unit located within the hermetically sealing casing and having a cylinder coming into engagement with a piston driven by the electric motor unit to reciprocate, a valve seat plate equipped with a plurality of adjacent suction holes and attached to an end portion of the cylinder, and a suction reed valve disposed between the cylinder end portion and the valve seat plate to open and close the plurality of suction holes, the valve seat plate is constructed such that partitions between the adjacent suction holes have a constant dimension (width). The formation of the partitions with a constant dimension between the plurality of suction holes can ensure a desired strength of the partition sections.

In addition, in accordance with this invention, in a hermetically sealed type compressor comprising an electric motor unit placed within a hermetically sealing casing, a compressor unit located within the hermetically sealing casing and having a cylinder coming into engagement with a piston driven by the electric motor unit to reciprocate, a valve seat plate equipped with a plurality of adjacent suction holes and attached to an end portion of the cylinder, a suction reed valve disposed between the cylinder end portion and the valve seat plate to open and close the plurality of suction holes, and a cylinder head attached to the valve seat plate and having a through-hole accommodating a passage pipe communicating with a suction muffler and provided align with the plurality of suction holes, the valve seat plate is equipped with a low-pressure space or room communicating with the plurality of suction holes. The formation of the low-pressure space can reduce the suction resistance between the opening of the passage pipe and the openings of the suction holes.

Furthermore, in accordance with this invention, in a hermetically sealed type compressor comprising an electric motor unit placed within a hermetically sealing casing, a compressor unit located within the hermetically sealing casing and having a cylinder coming into engagement with a piston driven by the electric motor unit to reciprocate, a valve seat plate equipped with a plurality of adjacent suction holes and attached to an end portion of the cylinder, a suction reed valve disposed between the cylinder end portion and the valve seat plate to open and close the plurality of suction holes, and a cylinder head attached to the valve seat plate and having a through-hole accommodating a passage pipe communicating with a suction muffler and provided to align with the plurality of suction holes, the valve seat plate is constructed such that partitions between the adjacent suction holes have a constant dimension, and is equipped with a low-pressure space communicating with the plurality of suction holes.

The low-pressure space is developed with a cavity or recess formed in the valve seat plate, and the plurality of suction holes stand in the cavity. Further, the low-pressure space is created with a groove made in the valve seat plate and establishing a communication between the plurality of suction holes.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE PREFERRED EMBODIMENTS

Figure 1:
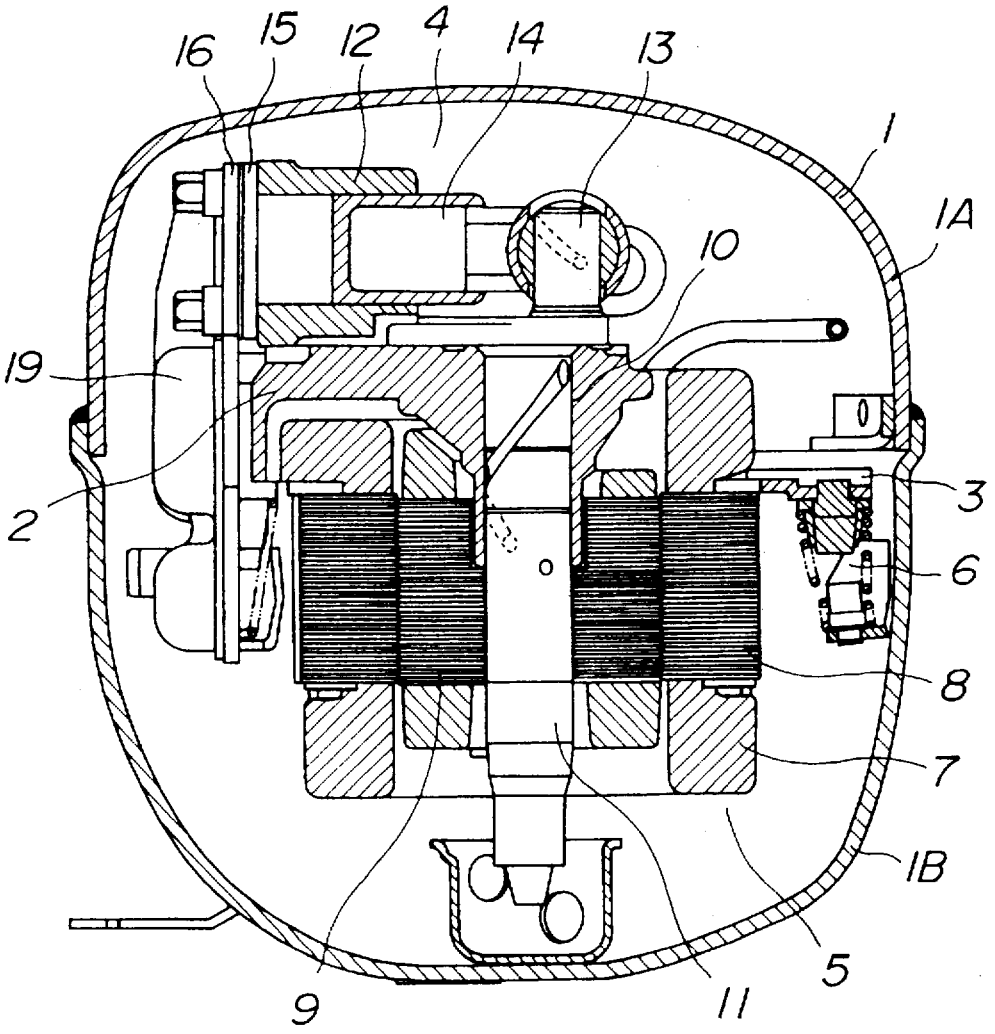
FIG. 1 is a side cross-sectional view showing a hermetically sealed type compressor according to this invention.
Figure 2:
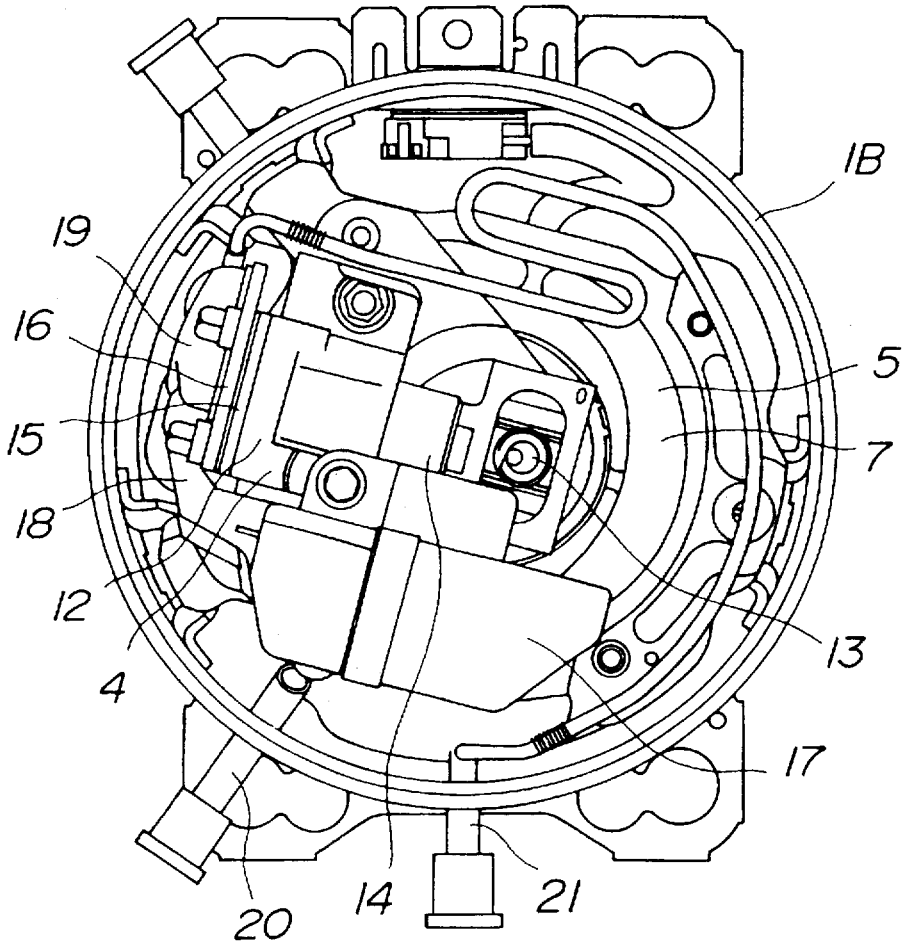
FIG. 2 is a plan view showing a hermetically sealed type compressor according to this invention.

Referring now to the drawings, a description will be made hereinbelow of an embodiment of the present invention. FIG. 1 is a side cross-sectional view showing a hermetically sealed type compressor according to this invention, and FIG. 2 is a plan view showing the same compressor from which an upper side casing is taken down. In the illustrations, reference numeral 1 designates a hermetically sealing casing composed of an upper side casing 1A and a lower side casing 1B, which accommodates two frames 2, 3, a compressor unit 4 located on or above the frames 2, 3, and an electric motor unit 5 situated under the frames 2, 3. The compressor unit 4 and the electric motor unit 5 are elastically attached through a supporting unit 6 to the inner wall of the hermetically sealing casing 1.

The electric motor unit 5 comprises a stator 8 having a winding 7 therein, a rotor 9 placed inside the stator 8, and a rotary shaft 11 mounted at the central section of the rotor 9 and rotatably supported with a bearing 10 of the frame 2. The compressor unit 4 comprises a cylinder 12, a piston 14 reciprocating within the cylinder 12 in response to eccentric rotations of a crank pin 13 made in connection with the rotary shaft 11, a valve seat plate 15 made of a sintered metal and located on an end surface of the cylinder 12, and a cylinder head 16 attached through the valve seat plate 15 to the cylinder 12. The cylinder head 16 is equipped with a passage pipe 18 being in communication with a suction muffler 17, and a discharge muffler 19. The suction muffler 17 and the discharge muffler 19 are communicated with a suction pipe 20 and a discharge pipe 21, respectively, and the compressor is coupled through the suction pipe 20 and the discharge pipe 21 to a refrigerating cycle for circulating a refrigerant such as R12 and R134a.

Figure 3:
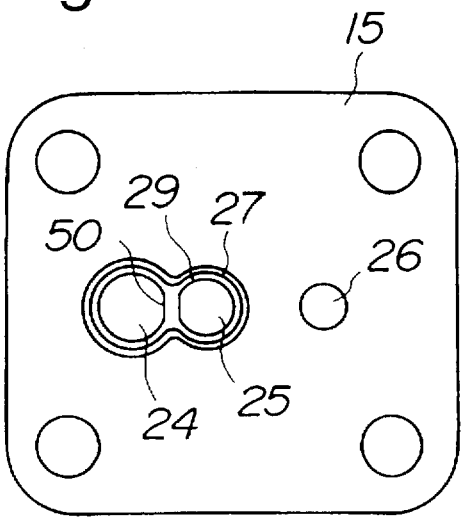
FIG. 3 is a plan view showing a valve seat plate of a hermetically sealed type compressor according to this invention from the cylinder head side.
Figure 4:
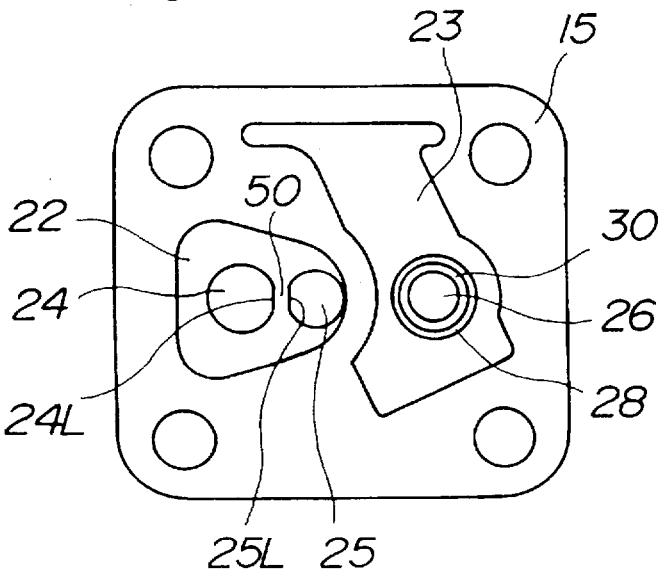
FIG. 4 is a plan view showing a valve seat plate of a hermetically sealed type compressor according to this invention from the piston side.
Figure 5:
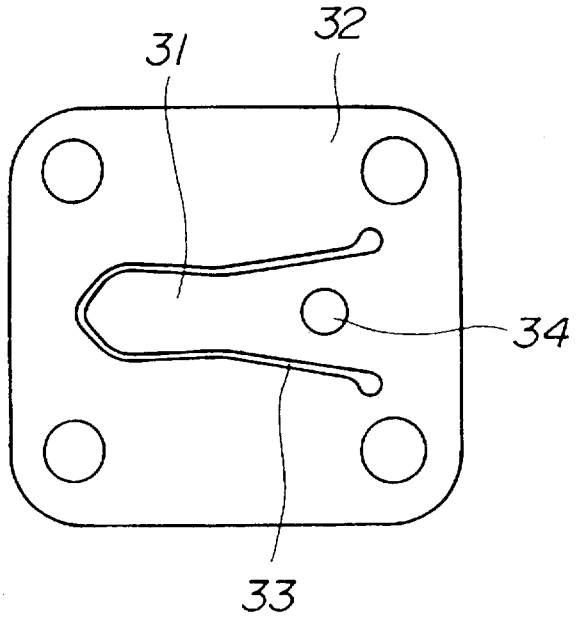
FIG. 5 is a plan view showing a suction reed valve of a hermetically sealed type compressor according to this invention.

FIGS. 3 and 4 show a detailed structure of the valve seat plate 15. Of these drawings, FIG. 3 is a plan illustration thereof viewed from the piston side and FIG. 4 is a plan illustration thereof viewed from the cylinder head side. A piston side surface of the valve seat plate 15 has cavities 22, 23, and in the cavity 22 there are made two suction holes 24, 25 adjacent to each other while in the cavity 23 there is made one discharge hole 26. These suction holes 24, 25 and discharge hole 26 are disposed such that their centers are on a straight line. A partition 50 between the two suction holes 24, 25 is made to have a constant dimension (width) to ensure a given strength. That is, each of the suction holes 24, 25 has a configuration comprising an arc portion and a linear portion 24L or 25L, the linear portions 24L and 25L being in opposed relation to each other. Valve seats 29, 30, being defined by grooves 27, 28, are provided around the openings of the suction holes 24, 25 and the discharge hole 26. The openings of the suction holes 24, 25 in the valve seat 29 side are opened and closed by means of a suction reed valve 31 shown in FIG. 5. The suction reed valve 31 is constructed by forming a notch portion 33 in a valve body 32 being a metal-made thin plate. In addition, the suction reed valve 31 has a notched hole 34 aligning with or corresponding to the discharge hole 26. The valve body 32 is superposed on the piston side surface of the valve seat plate 15 as illustrated and, together with the valve seat plate 15, is attached to an end surface of the cylinder 12. Incidentally, although not illustrated, in the cavity 23 there are situated a discharge reed valve for opening and closing the valve seat 30 side opening of the discharge hole and a valve guard for limiting the opening degree of the discharge reed valve.

Figure 6:
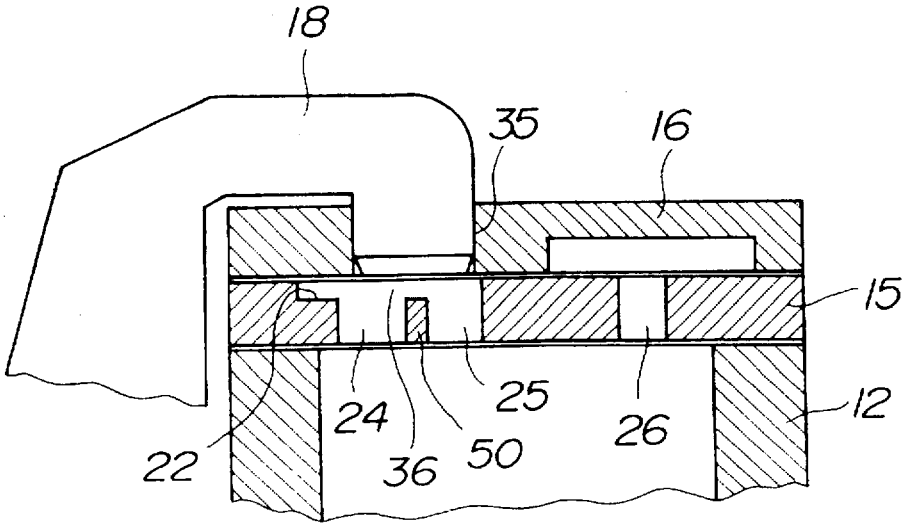
FIG. 6 is a cross-sectional view showing a principal section around an end portion of a cylinder of a hermetically sealed type compressor according to this invention.
Figure 7:
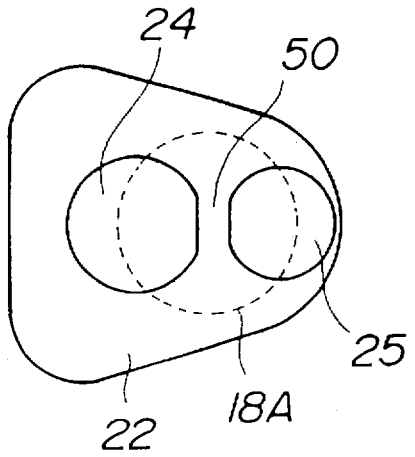
FIG. 7 is an illustration of suction holes of a hermetically sealed type compressor according to this invention.
Figure 10:
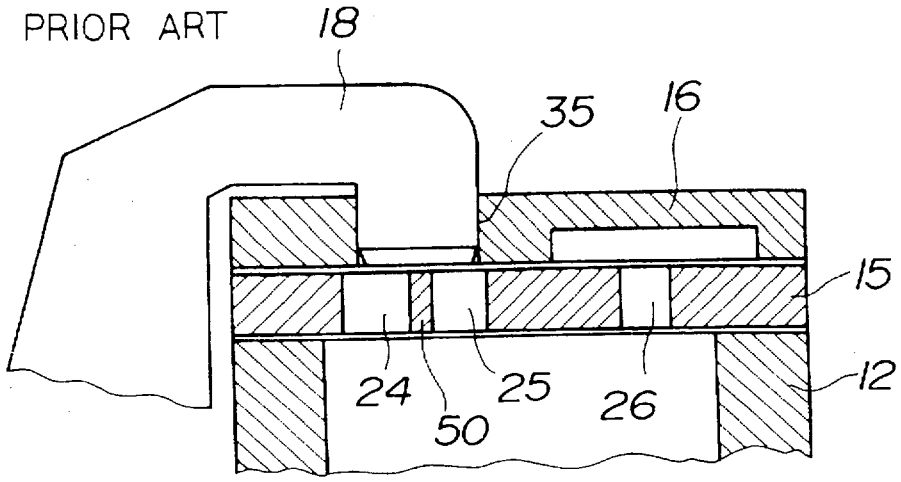
Fig.10 PRIOR ART
FIG. 10 is a cross-sectional view showing a principal section around an end of a cylinder of a prior hermetically sealed type compressor.

FIG. 6 is a cross-sectional view showing a principal section, i.e., a cylinder end section, more specifically schematically illustrating an assemble comprising the valve seat plate 15, the cylinder head 16 and the passage pipe 18 communicating with the suction muffler 17 in the end surface of the cylinder 12. The cylinder head 16 has a through-hole 35 at a position corresponding to the suction holes 24, 25 of the valve seat plate 15. One end portion of the passage pipe 18 is coupled with the suction muffler 17, and the other end portion thereof is inserted into the through-hole 35. The opening end surface of the passage pipe 18 is substantially positioned on the cylinder head side surface of the valve seat plate 15. The central portion of the opening of the passage pipe 18 is positioned to align with the central portion of the partition 50 between the suction holes 24, 25 as shown in FIG. 7 where the opening is indicated by a dotted line 18A. In a portion of the valve seat plate 15 which is in opposed relation to the opening of the passage pipe 18, there is formed a cavity 22 defining a low-pressure space 36 which establishes a communication between the two suction holes 24 and 25. The refrigerant gas from the suction pipe 20 is introduced into the cylinder 12 after passing through the suction muffler 17, the passage pipe 18, the low-pressure space 36 and the suction holes 24, 25 while the piston 14 comes down within the cylinder 12. In this instance, since the opening of the passage pipe 18 is in the confronting relation to the low-pressure space 36, the suction resistance becomes smaller due to the low-pressure space 36 as compared with that of the prior art example as shown in FIG. 10.

Figure 8:
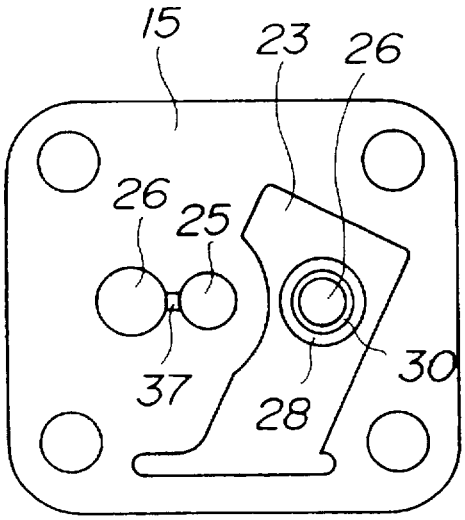
FIG. 8 is a plan view showing an alternative valve seat plate of a hermetically sealed type compressor according to this invention from the cylinder head side.

FIG. 8 shows another example of the valve seat plate 15 which can also reduce the suction resistance by the formation of the low-pressure space in the valve seat plate 15. FIG. 8 is a plan view of the valve seat plate 15 viewed from the cylinder head 16 side, where the same parts as those in FIG. 4 are marked with the same reference numerals. The feature is that a groove 37 establishing a communication between the two suction holes 24, 25 is made in the cylinder head side surface of the valve seat plate 15 to provide a low-pressure space 36 communicating with the two suction holes 24, 25. The groove 37 has a depth, for example approximately half the thickness of the valve seat plate 15, which does not reach the cylinder 12 side surface of the valve seat plate 15 so as to maintain the strength of the valve seat plate 15.

Figure 9:
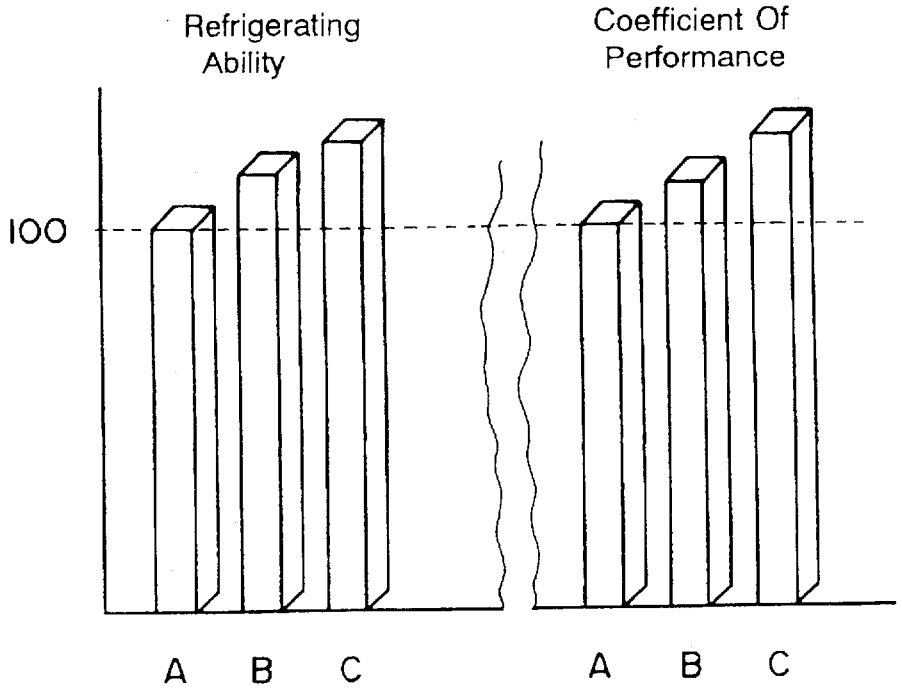
FIG. 9 is a graphic illustration available for the comparison in property between a hermetically sealed type compressor according to this invention and a prior hermetically sealed type compressor.

FIG. 9 is a graphic view showing experiment results of the refrigerating ability and coefficient of performance of the compressor according to this invention by comparison with a prior example. In FIG. 9, character A indicates the results in the case of using the FIG. 10 prior valve seat plate with no low-pressure space 36, character B indicates the results in the case of using the FIG. 8 valve seat plate 15 according to this invention, and character C shows the results in the case of using the FIG. 4 valve seat plate 15 according to this invention. In the valve seat plate 15 according to this invention the low-pressure space 36 is provided in a place facing the opening of the passage pipe 18, which is in communication with the suction muffler 17, to lessen the suction resistance, which can improve both the refrigerating ability and coefficient of performance.

As described above, since in the hermetically sealed type compressor the partitions between the plurality of suction holes in the valve seat plate are made to have a constant dimension, irrespective of the formation of the plurality of suction holes in the dimension-limited valve seat plate which permits a large suction amount, the strength of the partitions can be maintained. Further, since the low-pressure space is made in the valve seat plate to align with the passage pipe coupled to the suction muffler, the suction resistance reduces in sucking the refrigerant gas into the cylinder and hence the refrigerating ability and coefficient of performance of the hermetically sealed type compressor improve.

It should be understood that the foregoing relates to only preferred embodiments of the present invention, and that it is intended to cover all changes and modifications of the embodiments of the invention herein used for the purposes of the disclosure, which do not constitute departures from the spirit and scope of the invention.

What is claimed is:

1. A hermetically sealed type compressor comprising:

an electric motor unit placed within a hermetically sealing casing;

a compressor unit located within said hermetically sealing casing and having a cylinder and a piston, said cylinder being in engagement with said piston driven by said electric motor unit to reciprocate;

a valve seat plate equipped with a plurality of adjacent suction holes with partition disposed therebetween and attached to an end portion of said cylinder; and a suction reed valve disposed between the cylinder end portion and said valve seat plate to open and close said plurality of suction holes, wherein said valve seat plate is constructed such that the partition between said adjacent suction holes have a constant thickness in a direction separating said holes.

2. A hermetically sealed type compressor comprising:

an electric motor unit placed within a hermetically sealed casing;

a compressor unit located within said hermetically sealed casing and having a cylinder and a piston, said cylinder being in engagement with said piston driven by said electric motor unit to reciprocate;

a valve seat plate equipped with a plurality of adjacent suction holes and attached to an end portion of said cylinder;

a suction reed valve disposed between the cylinder end portion and said valve seat plate to open and close said plurality of suction holes; and a cylinder head attached to said valve seat plate and having a through-hole accommodating an opening side of a passage pipe communicating with a suction muffler, said through-hole being aligned with said plurality of suction holes, wherein said valve seat plate has a low-pressure space communicating with said plurality of suction holes.

3. A hermetically sealed type compressor comprising:

an electric motor unit placed within a hermetically sealing casing;

a compressor unit located within said hermetically sealing casing and having a cylinder and a piston, said cylinder being in engagement with said piston driven by said electric motor to reciprocate;

a valve seat plate equipped with a plurality of adjacent suction holes and attached to an end portion of said cylinder;

a suction reed valve disposed between the cylinder end portion and said valve seat plate to open and close said plurality of suction holes; and a cylinder head attached to said valve seat plate and having a through-hole accommodating a passage pipe communicating with a suction muffler and provided to align with said plurality of suction holes, wherein said valve seat plate is constructed such that partition between said adjacent suction holes have a constant dimension, and wherein said valve seat plate is equipped with a low-pressure space communicating with said plurality of suction holes.

4. A hermetically sealed type compressor as defined in claim 2, wherein said low-pressure space is made with a cavity formed in said valve seat plate, and said plurality of suction holes are made in said cavity.

5. A hermetically sealed type compressor as defined in claim 2, wherein said low-pressure space is made with a groove made in said valve seat plate and establishing a communication between said plurality of suction holes.

6. A hermetically sealed type compressor as defined in claim 3, wherein said low-pressure space is made with a cavity formed in said valve seat plate, and said plurality of suction holes are made in said cavity.

7. A hermetically sealed type compressor as defined in claim 3, wherein said low-pressure space is made with a groove made in said valve seat plate and establishing a communication between said plurality of suction holes.

8. The hermetically sealed type compressor of claim 1 wherein a suction hole positioned at the free end of the suction reed valve is larger than the other suction holes.

9. The hermetically sealed type compressor of claim 2 wherein a suction hole positioned at the free end of the suction reed valve is larger than the other suction holes.

10. The hermetically sealed type compressor of claim 3 wherein a suction hole positioned at the free end of the suction reed valve is larger than the other suction holes.

* * * * *